US009097469B2

(12) United States Patent
Foerster et al.

(10) Patent No.: US 9,097,469 B2
(45) Date of Patent: Aug. 4, 2015

(54) HEADER FOR A CONDENSER

(75) Inventors: Uwe Foerster, Erdmannhausen (DE); Kurt Molt, Bietigheim (DE)

(73) Assignee: MAHLE Behr GmbH & Co. KG, Stuttgart (DE)

( * ) Notice: Subject to any disclaimer, the term of this patent is extended or adjusted under 35 U.S.C. 154(b) by 738 days.

(21) Appl. No.: 13/311,049

(22) Filed: Dec. 5, 2011

(65) Prior Publication Data

US 2012/0138282 A1 Jun. 7, 2012

Related U.S. Application Data

(63) Continuation of application No. PCT/EP2010/056193, filed on May 6, 2010.

(30) Foreign Application Priority Data

Jun. 4, 2009 (DE) ..... 10 2009 023 954

(51) Int. Cl.
*F28F 9/02* (2006.01)
*F28D 1/053* (2006.01)
*F28D 21/00* (2006.01)

(52) U.S. Cl.
CPC ..... *F28F 9/0224* (2013.01); *F28D 1/05366* (2013.01); *F28F 9/026* (2013.01); *F28D 2021/0073* (2013.01)

(58) Field of Classification Search
CPC ..... F28F 9/02; F28F 9/0221; F28F 9/0224
USPC ..... 165/173, 175
See application file for complete search history.

(56) References Cited

U.S. PATENT DOCUMENTS

| | | | | |
|---|---|---|---|---|
| 4,971,145 | A * | 11/1990 | Lyon | 165/173 |
| 5,172,761 | A * | 12/1992 | Lyon | 165/173 |
| 6,564,863 | B1 * | 5/2003 | Martins | 165/175 |
| 7,121,332 | B2 * | 10/2006 | Förster et al. | 165/174 |
| 7,347,064 | B2 | 3/2008 | Katoh et al. | |
| 8,002,024 | B2 | 8/2011 | Higashiyama | |
| 2006/0162917 | A1 * | 7/2006 | Park et al. | 165/175 |

FOREIGN PATENT DOCUMENTS

| | | | |
|---|---|---|---|
| CA | 2 288 717 | C | 11/1998 |
| DE | 10 2006 040 848 | A1 | 3/2007 |
| DE | 11 2005 000 423 | T5 | 3/2007 |
| DE | 10 2007 016 050 | A1 | 10/2007 |
| DE | 10 2006 053 702 | A1 | 5/2008 |
| DE | 10 2008 007 937 | A1 | 10/2008 |
| EP | 2 090 851 | A1 | 8/2009 |
| GB | 2 390 148 | A | 12/2003 |
| JP | 2008286455 | A | 11/2008 |

* cited by examiner

*Primary Examiner* — Allen Flanigan
(74) *Attorney, Agent, or Firm* — Muncy, Geissler, Olds & Lowe, P.C.

(57) ABSTRACT

A header for a heat exchanger, which comprises a plurality of flat tubes arranged in a longitudinal direction. The header has a bottom and a lid. The bottom has a plurality of openings for coupling the header to the plurality of flat tubes. The lid is arranged opposite of the bottom and connected to the lid, at least at the edges extending in the longitudinal direction, in a fluid-tight manner. The lid has a plurality of transverse channels on a side facing the bottom, which are arranged opposite of the plurality of openings, and a longitudinal channel extending in the longitudinal direction.

14 Claims, 9 Drawing Sheets

HEADER FOR A CONDENSER

This nonprovisional application is a continuation of International Application No. PCT/EP2010/056193, which was filed on May 6, 2010, and which claims priority to German Patent Application No. DE 10 2009 023 954.5, which was filed in Germany on Jun. 4, 2009, and which are both herein incorporated by reference.

BACKGROUND OF THE INVENTION

1. Field of the Invention

The present invention relates to a header for a heat exchanger and to a heat exchanger, such as, for example, in a condenser.

2. Description of the Background Art

DE 10 2007 016 050 A1 describes a heat exchanger, which has tubes coupled to a header tank. The header tank comprises a plate element to which the ends of the tubes are coupled, a tank element connected to the plate element, and an intermediate element, arranged between the tank element and the plate element. In this case, a concept-related doubling of material results. This is disadvantageous for reasons of weight and thereby cost and from the soldering technology standpoint.

The headers of condensers, which are produced for the coolant R134a, can be made of two parts and have a bottom and a cover. Particularly in condensers for a CO2 coolant circuit, the so-called gas coolers, the previous structural form cannot be retained because of the higher pressure level.

SUMMARY OF THE INVENTION

It is therefore an object of the present invention to provide an improved header for a heat exchanger and an improved condenser.

The present invention is based on the realization that a two-part header can save weight and therefore cost. The arrangement of special channels in the interior of the header avoids the situation that the main flow channels are partially blocked by the flat tubes of the heat exchanger and thereby cause a pressure loss on the coolant side.

Therefore, the inventive approach can be used advantageously, inter alia, in heat exchangers, such as, for example, condensers, for example, for a CO2 coolant cycle, the so-called gas coolers, because the structural form of the invention is suitable for the higher pressure level arising thereby.

Advantageously, the inventive approach makes possible a cost saving, a weight reduction, a reduction of pressure losses, and an increase in process safety.

It is thus possible to produce a cost-effective and high-pressure-resistant heat exchanger header which is simpler to produce in comparison with the conventional art. The inventive design is notable for a lower pressure loss on the coolant side.

The present invention creates a header for a heat exchanger, which has a plurality of flat tubes arranged in a longitudinal direction, with the following features: a bottom, which has a plurality of openings for coupling the header to the plurality of flat tubes; and a cover, which is arranged opposite to the bottom that is connected fluid-tight to the cover, at least at the edges extending in the longitudinal direction, whereby the cover on a side facing the bottom has a plurality of transverse channels, which are arranged opposite to the plurality of openings, and a longitudinal channel extending in the longitudinal direction.

The heat exchanger may be a gas cooler for CO2 as a coolant. Alternatively, a different suitable gaseous or liquid fluid can be used as a coolant or cooling medium. The flat tubes can be formed to carry the fluid through the heat exchanger. The bottom represents a contact element between the heat exchanger and the header. The bottom can be fixedly connected to a long side of the heat exchanger. In this case, the bottom can be formed as a separate structural part or as part of the heat exchanger. The openings in the bottom can have a cross section conforming to the flat tubes. The ends of the flat tubes can be inserted in the openings. The outer sides of the flat tubes can be closed fluid-tight against the bottom. In this way, the openings enable an inflow of coolant from the flat tubes into an interior of the header and vice versa. The cover can be connected to the bottom in such a way that a hollow space is formed between the cover and the bottom. The hollow space can be formed by the longitudinal channel in the cover. The longitudinal channel can be formed as a recess or as a bent-out area in the cover. The longitudinal channel can extend over an entire length of the cover. The transverse channels can enlarge the hollow space between the cover and the bottom and each can be connected to the longitudinal channel. The transverse channels can be formed as a recess or as a bent-out area in the cover. The transverse channels can be oriented at right angles to the longitudinal channel. In particular, the transverse channels can be arranged opposite to the openings in the bottom and thereby to the ends of the flat tubes. A cross section of the transverse channels can be matched in its shape to a shape of a cross section of the ends of the flat tubes. In particular, the cross section of the transverse channels can be selected to be larger than the cross section of the ends of the flat tubes.

Each of the plurality of openings in the bottom can be formed to receive in each case an end of one of the plurality of flat tubes and each of the plurality of transverse channels can be formed to form a free space in each case between the cover and a respective end of one of the plurality of flat tubes. Thus, each flat tube can be assigned precisely one opening and precisely one cross channel. The free space enables a compensation of process variations during the production of the header or of the heat exchanger.

Each of the plurality of transverse channels can also be formed to enable fluid flow between the longitudinal channel and an interior of the plurality of flat tubes. An as frictionless as possible exchange of coolant between the flat tubes and the interior of the header is made possible thereby.

According to an embodiment, the plurality of transverse channels can be arranged on both sides of the longitudinal channel. Thus, the longitudinal channel can be arranged, for example, in the middle of the flat tubes. Alternatively, the plurality of transverse channels can be arranged on one side of the longitudinal channel.

Further, the bottom may have a plurality of additional transverse channels, which can be arranged opposite to the transverse channels of the cover. Thus, the cross section or the depth of the transverse channels arranged in the cover can be increased.

The bottom as well can have an additional longitudinal channel, which may be arranged opposite to the longitudinal channel of the cover. Thus, the cross section or the depth of the longitudinal channels arranged in the cover can be made larger.

According to an embodiment, the bottom may have a curvature to form the additional longitudinal channel. The curvature can be formed by an inner side of the header in the direction of the heat exchanger, when the bottom is connected to the heat exchanger.

Alternatively, a bottom surface section opposite to the longitudinal channel can be made planar. A bottom of this kind can be produced cost-effectively.

For example, the cover can be formed from a metal sheet or extruded. Thus, the cover can be fabricated by means of known manufacturing processes. In this case, the transverse channels can be formed by material doubling of the cover.

The bottom at edges extending in the longitudinal direction may have interconnections, which are formed to enclose opposite edges of the cover. The interconnections can comprise splice, press-fit, or TOX joints and create a connection between the bottom and cover, which is suitable for preventing the escape of a fluid within the header.

Further, the bottom and the cover can be formed to receive at least one partition wall at an end running transverse to the longitudinal direction. Thus, the partition wall can be pushed or slid into the header. The partition wall can be formed to create a closure for the header. The partition wall can also be used for flow guidance.

The present invention also provides a condenser with the following features: a heat exchanger, which has a plurality of flat tubes arranged in a longitudinal direction, and a header of the invention, which is connected to the heat exchanger.

A condenser of this kind can be used, for example, as a gas cooler for a CO2 coolant circuit.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
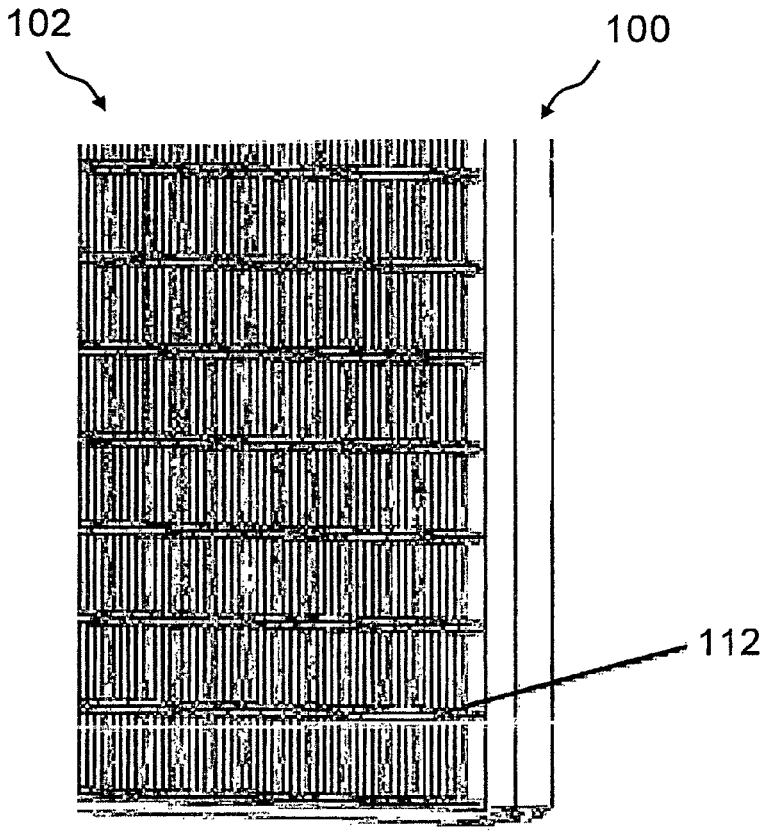
FIGS. 1 to 10 are illustrations of condenser views, according to a first exemplary embodiment of the present invention.

In the following description of the preferred exemplary embodiments of the present invention, identical or similar reference characters are used for elements shown in the various drawings and having a similar action, whereby a repeated description of these elements is omitted.

FIG. 1 shows a condenser with a header 100 and a heat exchanger 102, according to an exemplary embodiment of the present invention. Heat exchanger 102 has a plurality of flat tubes 112, which are coupled to header 100. For the sake of clarity, only one of the shown flat tubes is provided with the reference character 112. Header 100 is connected to heat exchanger 102 at one of its ends.

Flat tubes 102 are oriented parallel to one another and arranged next to one another in regard to a longitudinal direction. Header 100 is oriented in the longitudinal direction, so that flat tubes 112 can be oriented orthogonal to header 100. Cooling elements, for example, cooling fins, can be arranged between flat tubes 112. Flat tubes 112 are formed to carry a coolant, for example, a fluid. On the side facing header 100, respective ends of flat tubes 112 are connected to the corresponding openings of header 100. In this way, the coolant can flow out of flat tubes 112 into header 100 and vice versa.

Figure 2:
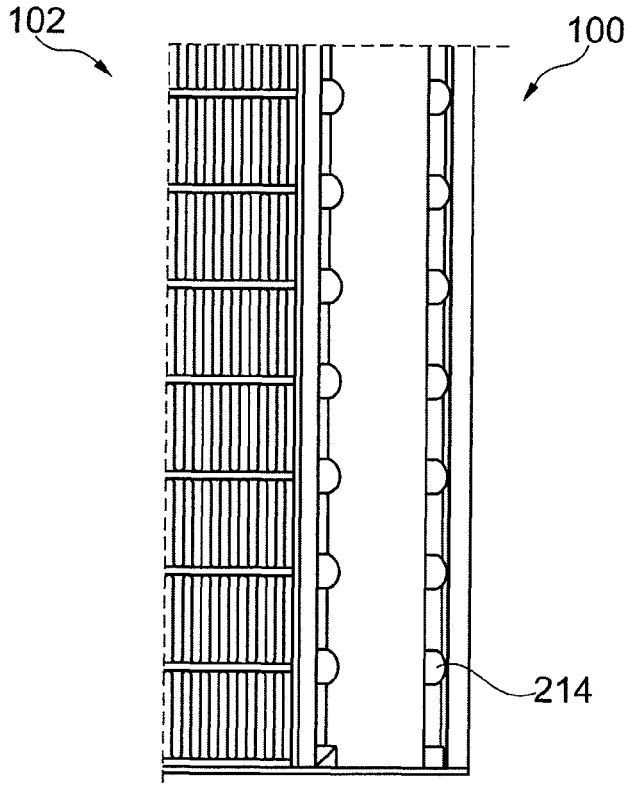

FIG. 2 shows a cross-sectional illustration of the condenser, shown in FIG. 1, with header 100 and heat exchanger 102. Shown are a plurality of transverse channels 214, which are arranged on an inner side, opposite to the flat tubes, of header 100. For the sake of clarity, only one of the shown transverse channels is provided with the reference character 214.

Figure 3:
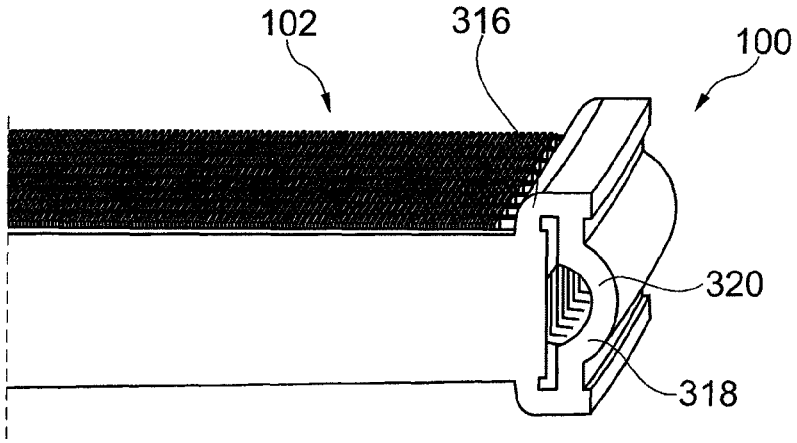

FIG. 3 shows a side view of the condenser, shown in FIG. 1, with header 100 and heat exchanger 102. Header 100 has a bottom 316 and a cover 318. Bottom 316 and cover 318 are connected together on their edges running in the longitudinal direction so that the coolant in header 100 cannot escape. Bottom 316 and cover 318 are designed so that a hollow space for carrying the coolant arises between them. Further, cover 318 can have a longitudinal channel 320 for carrying the coolant. According to this exemplary embodiment, cover 318 has an outwardly directed curvature for this purpose. The curvature can be formed in the middle in cover 318 and run in the longitudinal direction over the entire length of cover 318. Bottom 316 can be connected fixedly to a base body of heat exchanger 102 or be part thereof. Bottom 316 has on a side facing the heat exchanger openings for receiving the end pieces of the flat tubes arranged in the heat exchanger. The coolant can be exchanged via the openings between the flat tubes and the interior space of header 100, said space arranged between bottom 316 and cover 318.

Figure 4:
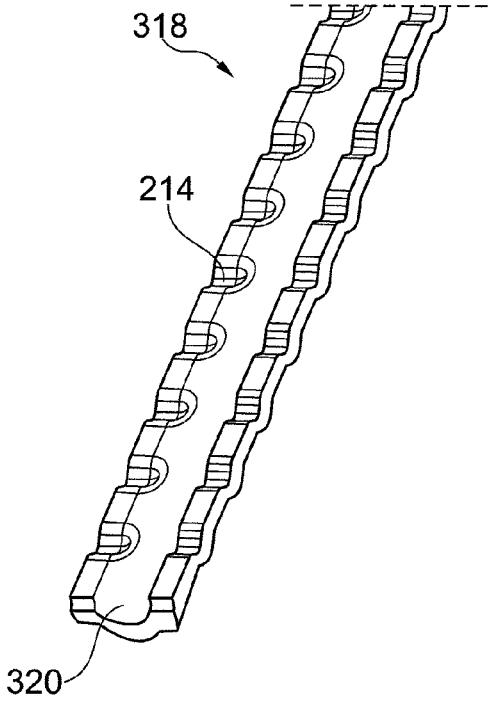

FIG. 4 shows an illustration of cover 318 of the condenser shown in FIG. 1, according to an exemplary embodiment of the present invention. Cover 318 has a plurality of transverse channels 214 transverse to the longitudinal direction and thereby transverse to longitudinal channel 320. The number of transverse channels in this case can correspond to the number of the flat tubes of the heat exchanger to which the header is coupled. When cover 318 is connected to the bottom, transverse channels 214 can be oriented opposite to the openings in the bottom and thereby opposite to the flat tubes. In this way, the coolant can enter the flat tubes via transverse channels 214 or leave the flat tubes via transverse channels 214. Transverse channels 214 in each case can run over the entire width of cover 318. Transverse channels 214 form depressions in the cover and in each case can be interrupted in the middle by longitudinal channel 320, so that in each case opposite subsections of transverse channels 214 can run on both sides of longitudinal channel 320. Longitudinal channel 320 is thus connected to transverse channels 314, such that the coolant can flow back and forth between longitudinal channel 320 and transverse channels 314.

Figure 5:
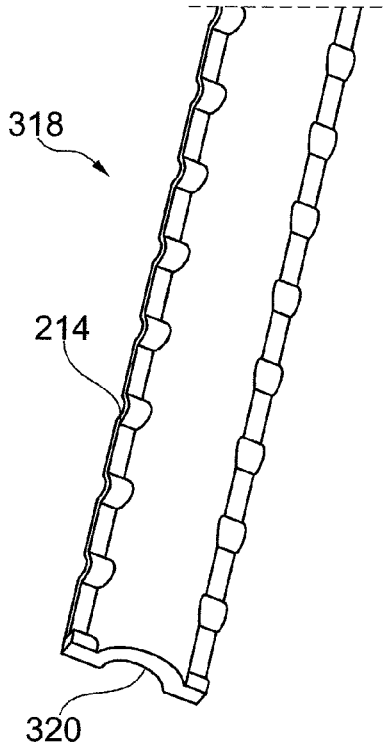

FIG. 5 shows a back view of cover 318, shown in FIG. 4, with longitudinal channel 320 and transverse channels 214. The cover shown in FIGS. 4 and 5 can be formed from a metal sheet.

Figure 6:
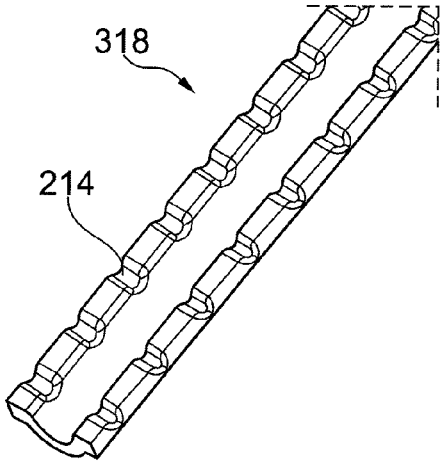

FIG. 6 shows an illustration of cover 318 of the condenser shown in FIG. 1, according to another exemplary embodiment of the present invention. The shown cover 318, in comparison with the exemplary embodiment shown in FIG. 4, was produced by a different manufacturing process.

Figure 7:
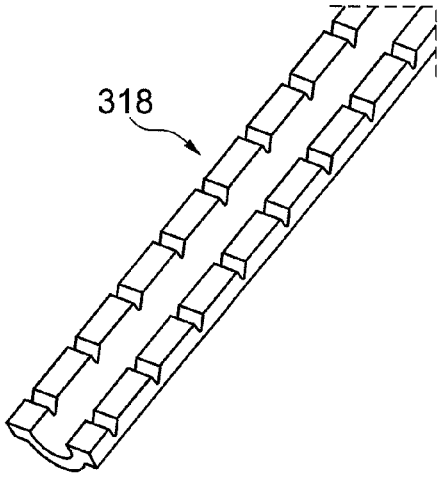

FIG. 7 shows an illustration of cover 318 of the condenser shown in FIG. 1, according to another exemplary embodiment of the present invention. The shown cover 318, in comparison with the exemplary embodiment shown in FIG. 4, was produced by a different manufacturing process. The covers shown in FIGS. 6 and 7 can be extruded.

Figure 8:
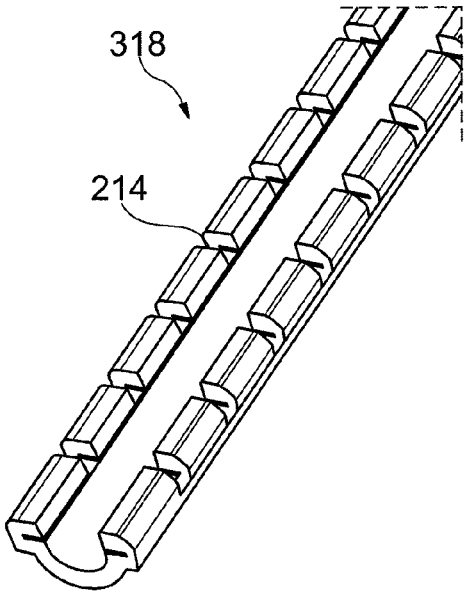

FIG. 8 shows an illustration of cover 318 of the condenser shown in FIG. 1, according to another exemplary embodiment of the present invention. The shown cover 318, in comparison with the exemplary embodiment shown in FIG. 4, was produced by a different manufacturing process. According to this exemplary embodiment, transverse channels 214 can be formed by material doubling. For this purpose, the edges, running in the longitudinal direction, of cover 318 can be bent inwardly, i.e., on the side to be connected to the bottom. Areas of transverse channels 214 can be omitted in this case, so that the bent edges can form the areas that are arranged in each case between two neighboring transverse channels 214.

Figure 9:
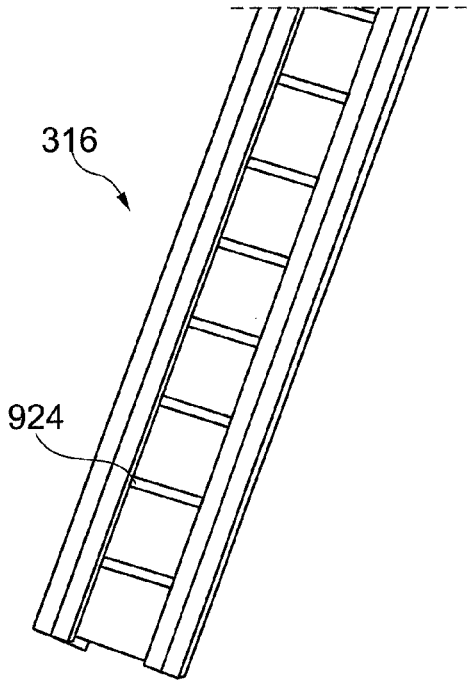

FIG. 9 shows an illustration of bottom 316 of the condenser shown in FIG. 1, according to an exemplary embodiment of the present invention. Bottom 316 has a plurality of openings 924 transverse to the longitudinal direction. The number of openings 924 in this case can correspond to the number of the flat tubes of the heat exchanger to which the header is coupled. When bottom 316 is coupled to the heat exchanger, the ends of the flat tubes in each case can engage in one of the corresponding openings 924. Bottom 316 at the edges running in the longitudinal direction has connecting elements with which a fixed connection between bottom 316 and the cover can be made.

Figure 10:
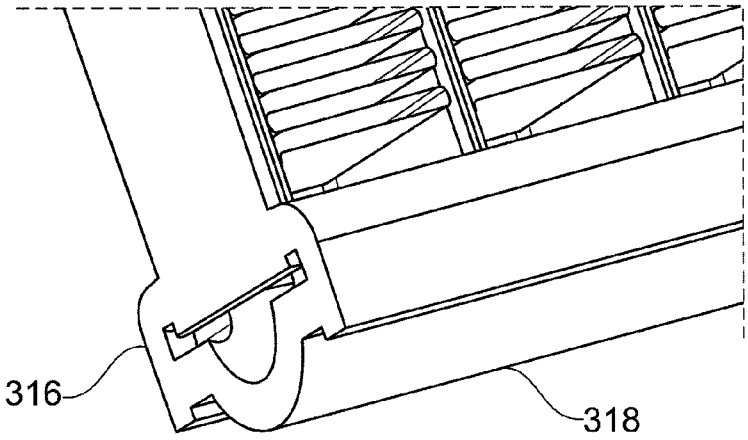

FIG. 10 shows another illustration of the condenser shown in FIG. 1. In particular, an arrangement of bottom 316 and cover 318 is shown, which together form the header.

Figure 11:
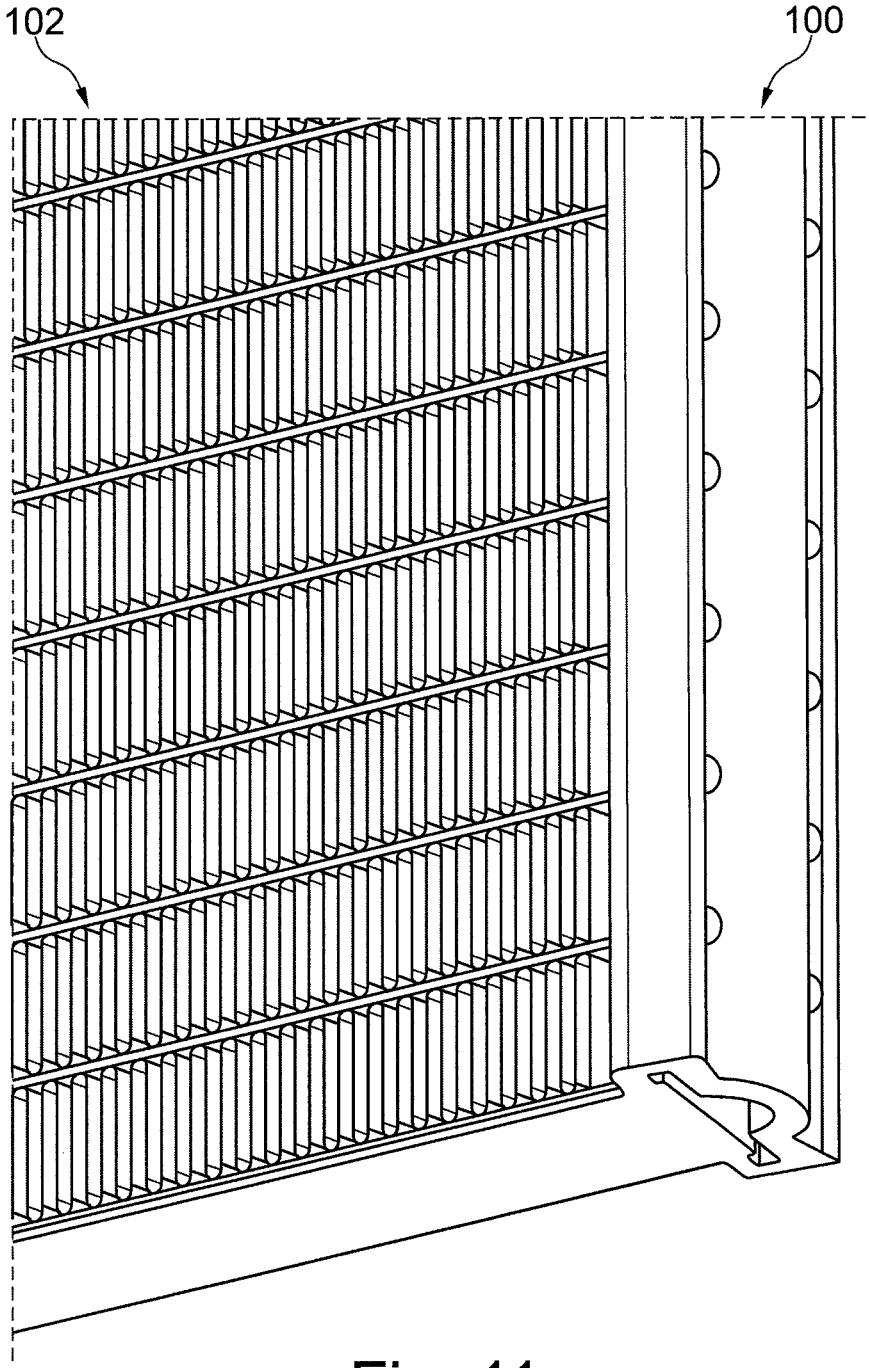
FIGS. 11 to 13 are illustrations of condenser views, according to another exemplary embodiment of the present invention.
Figure 12:
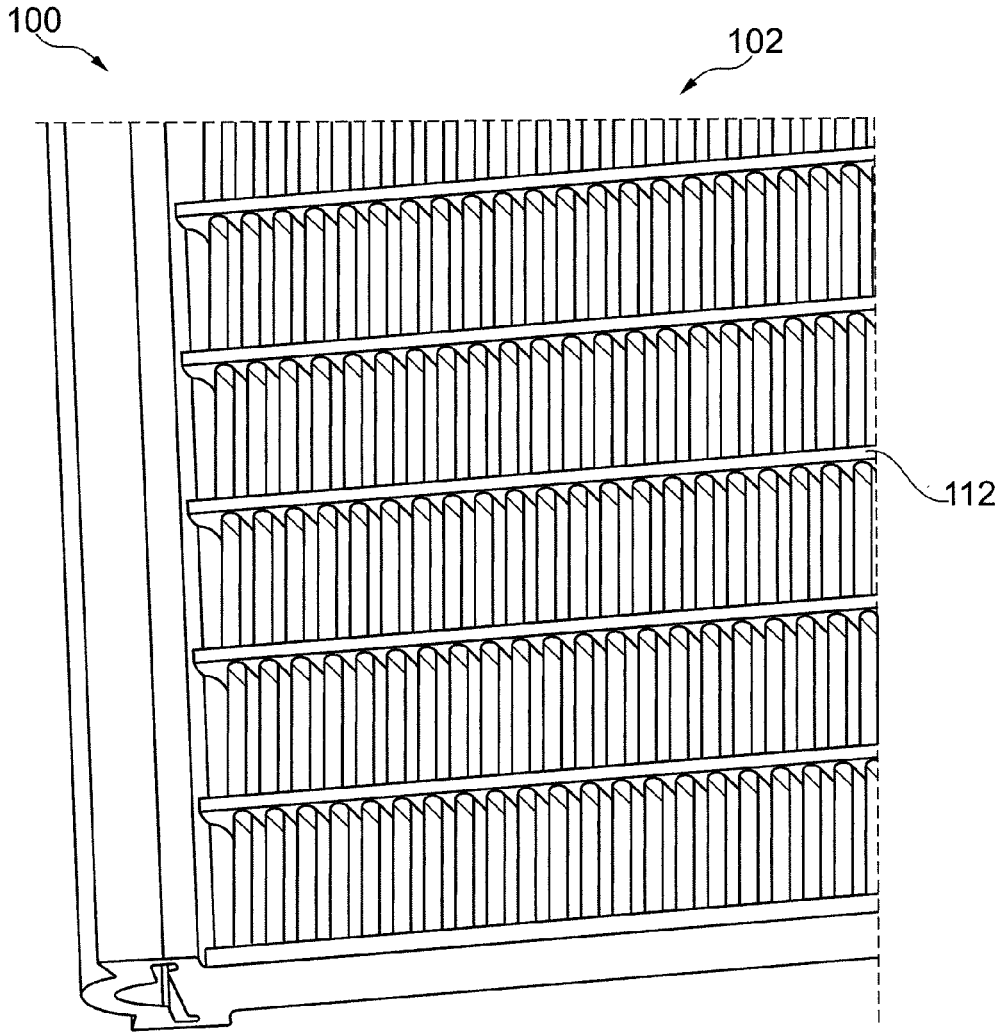
Figure 13:
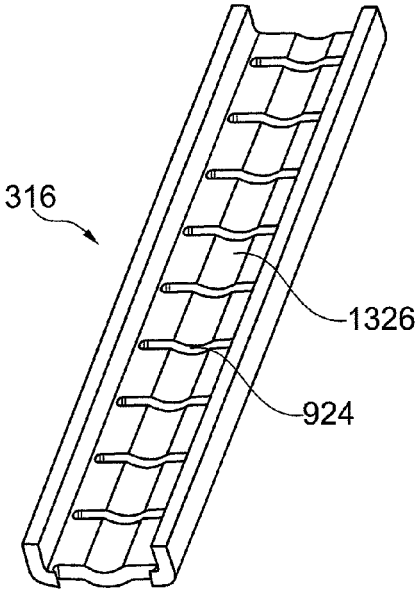

FIGS. 11 to 13 show a condenser according to another exemplary embodiment of the present invention. According to this exemplary embodiment, the header can have a curved bottom. All other elements can correspond to the elements described with FIGS. 1 to 10.

FIG. 11 shows an illustration of the condenser with header 100 and heat exchanger 102.

FIG. 12 shows another illustration of the condenser with header 100 and heat exchanger 102. Further, flat channels 112 of the heat exchanger are shown, only one of which is provided with reference character 112 for the sake of clarity.

FIG. 13 shows an illustration of bottom 316 of the condenser shown in FIG. 11, according to an exemplary embodiment of the present invention. Bottom 316 has a plurality of openings 924 transverse to the longitudinal direction. The number of openings 924 in this case can correspond to the number of flat tubes of the heat exchanger to which the header is coupled. When bottom 316 is coupled to the heat exchanger, the ends of the flat tubes in each case can engage in one of the corresponding openings 924. Further, bottom 316 has a longitudinal channel 1326. Longitudinal channel 1326 together with the longitudinal channel of the cover can be used for carrying the coolant within the header. According to this exemplary embodiment, bottom 316 for this purpose has a curvature directed outwardly, i.e., in the direction of the heat exchanger. The curvature is formed in the middle in bottom 316 and can run in the longitudinal direction over the entire length of bottom 316. Bottom 316 at the edges running in the longitudinal direction has connecting elements with which a fixed connection between bottom 316 and the cover can be made.

FIGS. 14 to 17 show a condenser according to another exemplary embodiment of the present invention. According to this exemplary embodiment, the header may have a longitudinal channel arranged off-center. All remaining elements, apart from conditions resulting from the arrangement of the longitudinal channel, can correspond to the elements described in of FIGS. 1 to 13.

Figure 14:
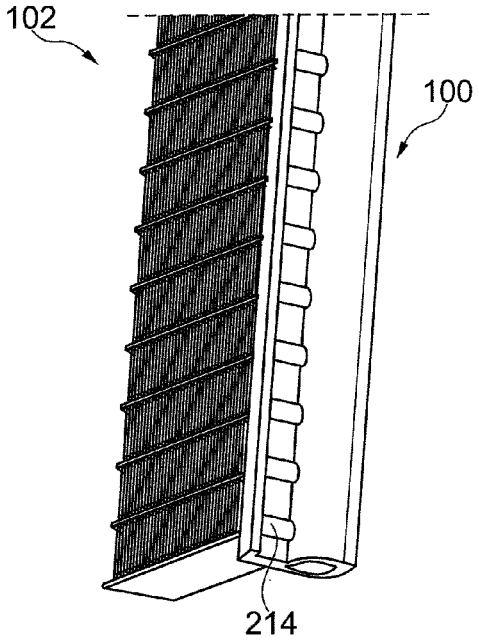
FIGS. 14 to 17 are illustrations of condenser views, according to another exemplary embodiment of the present invention.

FIG. 14 shows an illustration of the condenser with header 100 and heat exchanger 102. According to this exemplary embodiment, transverse channels 214 are arranged only on one side of the longitudinal channel.

Figure 15:
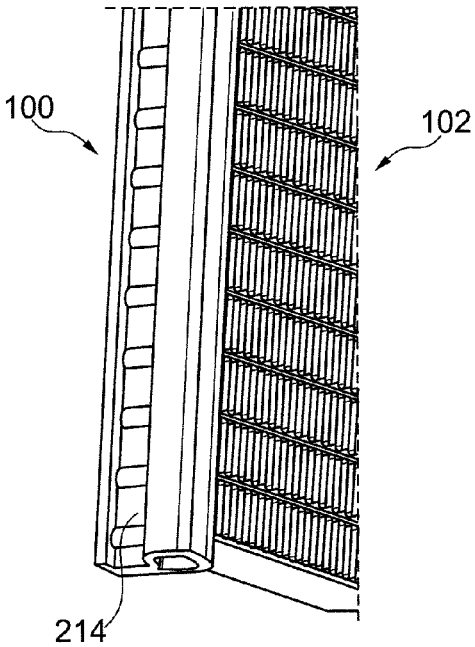

FIG. 15 shows another illustration of the condenser with header 100, heat exchanger 102, and transverse channels 214.

Figure 16:
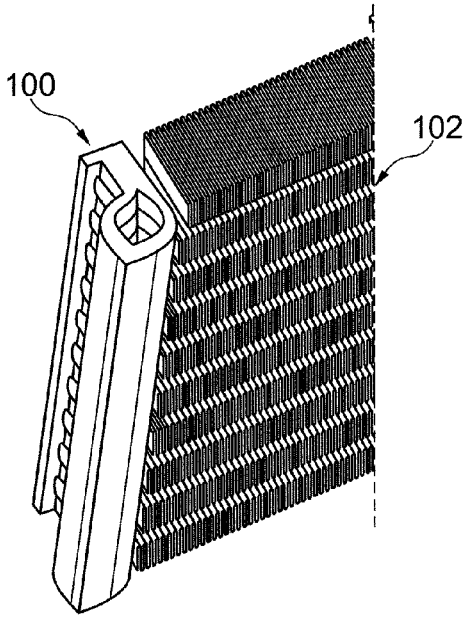

FIG. 16 shows another illustration of the condenser with header 100 and heat exchanger 102.

Figure 17:
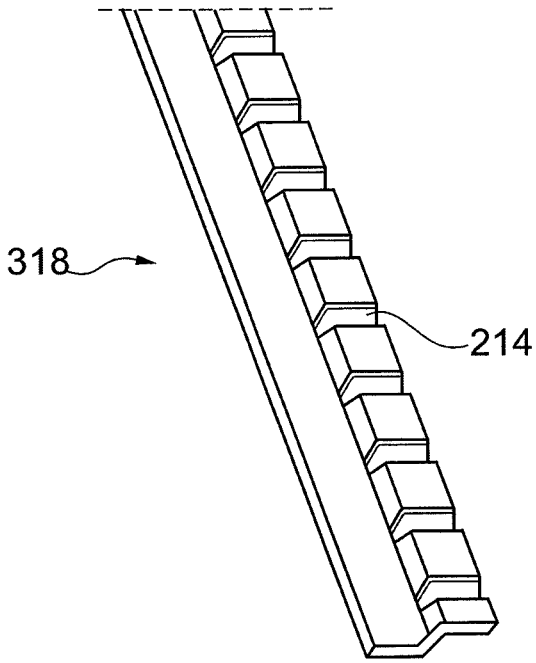

FIG. 17 shows an illustration of cover 318 of the condenser shown in FIG. 14, according to an exemplary embodiment of the present invention. Along the longitudinal direction, cover 318 has on one side a depression in the form of an outwardly directed curvature, which forms the longitudinal channel. Transverse to the longitudinal direction, cover 318 has a plurality of transverse channels 214, which open into the longitudinal channel. Transverse channels 214 can be oriented opposite to the openings in the bottom, when cover 318 is connected to the bottom in order to form the header. In this case, the openings in the bottom can end with transverse channels 214 or extend into the area of the longitudinal channel.

Figure 18:
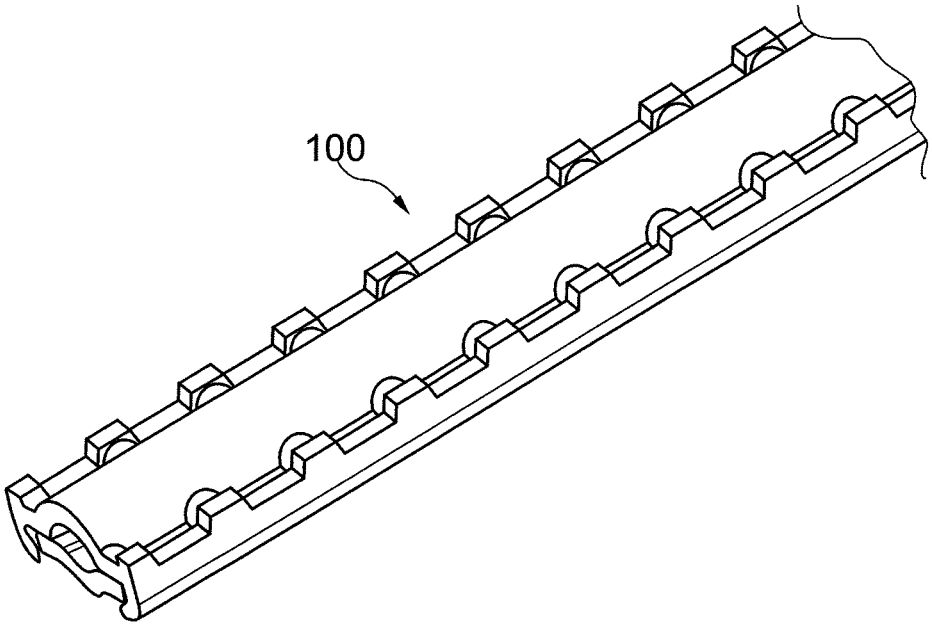
FIGS. 18 to 20 are views of bottoms, according to additional exemplary embodiments of the present invention.
Figure 19:
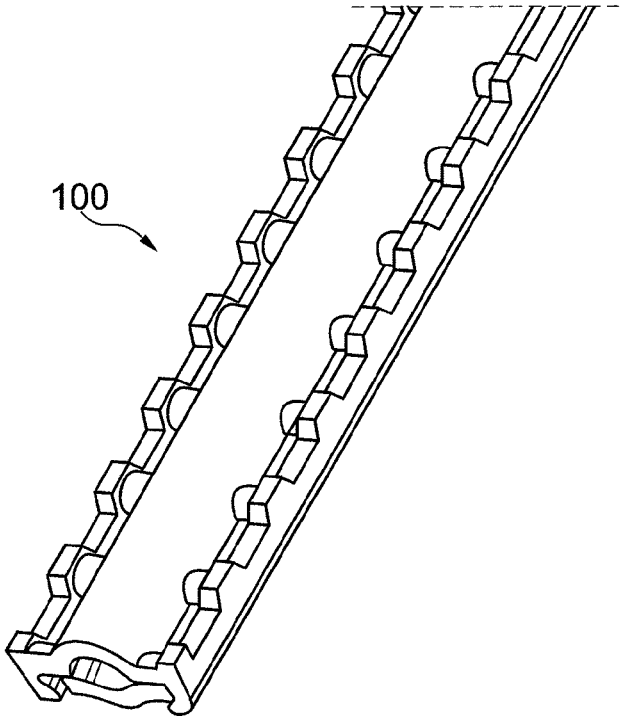
Figure 20:
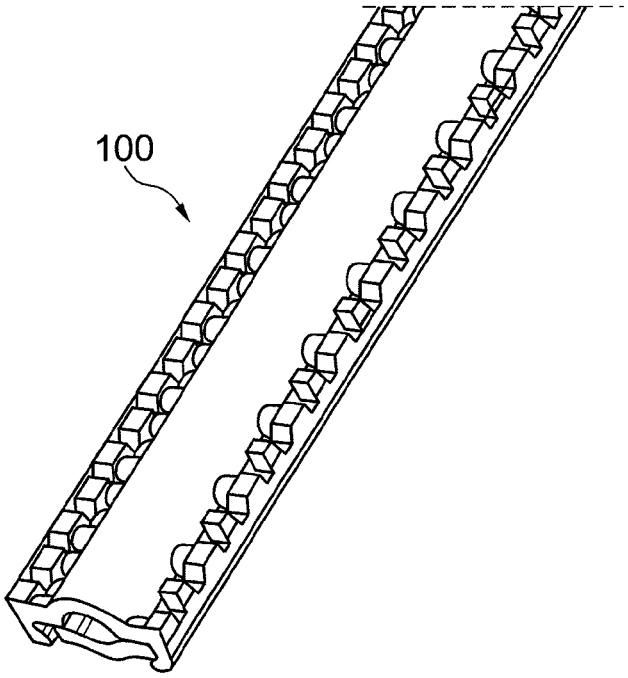

FIGS. 18 to 20 show exemplary embodiments of header 100 with a rim at the bottom.

As shown in FIGS. 1 to 3, the solution of the invention provides a header 100 with a bottom 316 and a cover 318. As shown in FIG. 9, in this case, bottom 316 can be preferably planar (FIGS. 1 to 10) or curved (FIGS. 11 to 13). Bottom 316 is used to receive and connect flat tubes 112 of the heat exchanger. This can occur by means of soldering. Cover 318 has a so-called longitudinal channel 320, which extends in the longitudinal direction of header 100. So-called transverse channels 214 are made in cover 318 corresponding to passages 924 in bottom 316, in the optimal case, on both sides of longitudinal channel 320. However, also conceivable is a one-sided integration, as shown in FIGS. 14 to 17. Transverse channels 214 have the task of creating a free space at the flat tube ends. This is needed to enable inflow and outflow into/out of flat tube 112. In addition, transverse channels 214 are used to compensate for process variations in the insertion depth.

Cover 318 itself can be formed from a metal sheet, as shown in FIGS. 4 and 5, or also extruded, as shown in FIGS. 6 and 7.

Bottom 316 encloses cover 318. Both parts 316, 318 are connected together by splice, press-fit, or TOX joints, or the like.

The flow guidance and the closing of header 100 at the ends are achieved by so-called partition walls. These are slid or pushed into header 100.

According to an alternative exemplary embodiment, the transverse channels, as shown in FIG. 8, can be achieved by material doubling of cover 318. Optionally, in addition bottom 316 may have transverse channels 214 to increase the depth or the cross section of transverse channel 214. In addition, cover 318 may have other fasteners, projections, or the like where flanges, fasteners or the like may be attached.

The described exemplary embodiments are selected only by way of example and can be combined with one another.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A header for a heat exchanger, the header comprising:

a plurality of flat tubes arranged in a longitudinal direction;

a bottom, which has a plurality of openings for coupling the header to the plurality of flat tubes; and a cover, which is arranged opposite to the bottom that is connected fluid-tight to the cover, at least at edges extending in the longitudinal direction, wherein the cover on a side facing the bottom has a plurality of transverse channels, which are arranged opposite to the plurality of openings, wherein the cover has a longitudinal channel extending in the longitudinal direction, wherein side edges of the cover, provided on either side of the longitudinal channel, are planar, the planar side edges extending in the longitudinal direction, and wherein the plurality of transverse channels are provided at the planar side edges of the cover.

2. The header according to claim 1, wherein each of the plurality of openings is formed to receive in each case an end of one of the plurality of flat tubes and each of the plurality of transverse channels is formed to form a free space in each case between the cover and a respective end of one of the plurality of flat tubes.

3. The header according to claim 1, wherein each of the plurality of transverse channels is formed to enable fluid flow between the longitudinal channel and an interior of the plurality of flat tubes.

4. The header according to claim 1, wherein the plurality of transverse channels is arranged on one side of the longitudinal channel.

5. The header according to claim 1, wherein the bottom has a plurality of additional transverse channels, which are arranged opposite to the transverse channels of the cover.

6. The header according to claim 1, wherein the bottom has an additional longitudinal channel, which is arranged opposite to the longitudinal channel of the cover.

7. The header according to claim 6, wherein the bottom has a curvature to form the additional longitudinal channel.

8. The header according to claim 1, wherein the cover is formed from a metal sheet or is extruded.

9. The header according to claim 1, wherein the transverse channels are formed by material doubling of the cover.

10. The header according to claim 1, wherein the bottom at the edges extending in the longitudinal direction has interconnections which are designed to enclose the opposite edges of the cover.

11. The header according to claim 1, wherein the bottom and the cover are designed to receive at least one partition wall at an end running transverse to the longitudinal direction.

12. A condenser comprising:

a heat exchanger having a plurality of flat tubes arranged in a longitudinal direction; and a header according to claim 1, which is connected to the heat exchanger.

13. The header according to claim 1, wherein the plurality of transverse channels is arranged on both sides of the longitudinal channel.

14. The header according to claim 1, wherein the plurality of transverse channels extend perpendicular to the longitudinal direction.

* * * * *